US007165490B2

(12) United States Patent
Futamura et al.

(10) Patent No.: US 7,165,490 B2
(45) Date of Patent: Jan. 23, 2007

(54) PRESS FORMING METHOD

(75) Inventors: Shoji Futamura, Kawasaki (JP); Keizo Unno, Tokyo (JP)

(73) Assignee: Hoden Seimitus Kako Kenkyusho Co., Ltd. (JP)

( * ) Notice: Subject to any disclaimer, the term of this patent is extended or adjusted under 35 U.S.C. 154(b) by 201 days.

(21) Appl. No.: 10/524,321

(22) PCT Filed: Oct. 9, 2003

(86) PCT No.: PCT/JP03/12940

§ 371 (c)(1),
(2), (4) Date: Feb. 9, 2005

(87) PCT Pub. No.: WO2004/037531

PCT Pub. Date: May 6, 2004

(65) Prior Publication Data

US 2005/0235844 A1 Oct. 27, 2005

(30) Foreign Application Priority Data

Oct. 23, 2002 (JP) ..... 2002-307935

(51) Int. Cl.
*B30B 15/24* (2006.01)
*B30B 13/00* (2006.01)

(52) U.S. Cl. ..... 100/46; 100/35; 100/258 R; 72/17.2; 72/21.4; 72/443; 700/165

(58) Field of Classification Search ..... 100/35, 100/46, 258 R, 258 A; 72/17.2, 21.1, 21.4, 72/20.1, 31.11, 443, 454; 700/165
See application file for complete search history.

(56) References Cited

U.S. PATENT DOCUMENTS 4,797,831 A * 1/1989 Dressing et al. ..... 700/165
4,828,474 A * 5/1989 Ballantyne ..... 425/150
6,189,364 B1 * 2/2001 Takada ..... 72/702
6,595,122 B1 * 7/2003 Mukai et al. ..... 100/46
6,810,704 B2 * 11/2004 Futamura et al. ..... 72/17.2

FOREIGN PATENT DOCUMENTS

| | | |
|---|---|---|
| EP | 1 240 999 A1 | 9/2002 |
| JP | 10-277791 | 10/1998 |
| JP | 2000-15341 | 1/2000 |
| JP | 2000-79500 | 3/2000 |

* cited by examiner

*Primary Examiner*—Lowell A. Larson

*Assistant Examiner*—Jimmy Nguyen

(74) *Attorney, Agent, or Firm*—McGlew & Tuttle, PC

(57) ABSTRACT

A press forming method is disclosed, wherein press forming can be effected at high speed while maintaining the horizontal state of a slide plate in press-forming a work-piece by a press machine. A press machine is used in which the slide plate is pressed by a plurality of drive sources using servomotors for driving. The speed of one of the plurality of drive sources is set to a target speed for production forming for the drive source, and by using a function that shows a delay in terms of a speed of the drive source and a load thereon and also using a load separately found, the respective speeds of the drive sources are found so as to eliminate the delay between the drive sources. Trial forming is repeated on the basis of the thus-found speed to derive conditions that enable press-forming at high speed while maintaining the horizontal state of the slide plate.

4 Claims, 5 Drawing Sheets

PRESS FORMING METHOD

TECHNICAL FIELD

The invention relates to a press forming method in which a slide plate is maintained to be horizontal during press forming, using a press machine that drives a slide plate or a pressing plate by a plurality of drive sources, e.g. servo-motors, to press-form.

BACKGROUND ART

A press machine for press-forming a work-piece has a structure which has a fixed plate, a slide plate opposite to the fixed plate, a fixed die disposed on the fixed plate and a movable die disposed on the slide plate facing the fixed plate to open and close the movable die against the fixed die by moving the slide plate relatively to the fixed plate. In a small press machine, there is a single drive source provided in a center of a slide plate. Using a large slide plate, the single drive source disposed in a center of the slide plate cannot uniformly press the slide plate. Therefore, using a plurality of drive sources to cause a uniform pressing force on a slide plate, each of the plurality of drive sources presses a respective engaging portion disposed on the slide plate to form a press plane on the slide plate. As the plurality of drive sources, there have two, four or six ones, for example, been used.

When a slide plate is descending against a fixed plate to close a movable die against a fixed die and to increase a pressing force, magnitudes of loads working to the movable die through a plate to be formed are changing and working positions of the loads on the movable die are, also, varying. The variations of the magnitudes and the working positions of the loads cause imbalance on load working on the slide plate. A distance from a working position of a load on the slide plate to a drive source, also, is varied. Then, imbalance in load moments acting to the drive sources is caused.

When servo-motors are used for drive sources of a press machine, revolutions of the servo-motors are delayed by loads working to the drive sources. So, since a drive source subjected to a large load is more delayed in proceeding than a drive source subjected to a small load, a slide plate is caused to incline relatively to a fixed plate. The inclination of the slide plate causes a die to incline and often to be injured. When the inclination of the slide plate is small, the die is not injured but may reduce accuracy in press-forming a work-piece.

As a countermeasure, an inclination of a slide plate has been corrected by detecting/measuring the inclination of the slide plate during a progress of the press-forming and adjusting a driving signal supplied to each of the drive sources to reduce/eliminate the inclination of the slide plate. Such a feed-back control can prevent the slide plate from inclining during press-forming.

However, when a slide plate inclination is prevented during press-forming by the feed-back control, a cycle of press forming takes a long time. In a press-forming of a work piece, it is usual that a same kind of work-pieces is repeatedly formed to produce a large number of work-pieces. If a cycle of press-forming takes a long time, there is a problem that a production of a large number of work-pieces takes an extremely long time.

DISCLOSURE OF THE INVENTION

An object of the invention, therefore, is to provide a press-forming method that enables press-forming at a high forming speed suitable for mass production, while maintaining a slide plate horizontal.

The invention has been made on the basis of discovery that a delay of a slide plate on the way of press-forming is shown by a function of a load working on the slide plate from a work-piece.

A press forming method of the invention comprises the steps of:

providing a press machine comprising a fixed plate, a slide plate disposed to face the fixed plate and movable relatively to the fixed plate and a plurality of drive sources each having a servo-motor for driving the slide plate and pressing each of a plurality of engaging portions positioned on the slide plate to press horizontally the slide plate, measuring a load working on each of the plurality of drive sources at each of descending displacements of the slide plate, while the slide plate is displaced to press-form a work-piece, applying the load at each of the descending displacements and a target speed for production forming for one (hereinafter referred to as "reference drive source") of the plurality of drive sources at each of the descending displacements to a function that shows a delay of a drive source from an instructed displacement in terms of a speed of the drive source and a load working on the drive source, thereby calculating a speed (hereinafter referred to as "compensation speed") for each of the plurality of drive sources to eliminate a delay for each of the plurality of drive sources from the reference drive source, driving each of the plurality of drive sources at the compensation speed to press-form a work-piece in a trial forming, measuring a delay of each of the plurality of drive sources during the trial forming, until delays of other drive sources from the reference drive source become not more than a predetermined value, repeating correction of the compensation speed, the trial forming and the measurement of the delay during the trial forming, and when the delays of the other drive sources from the reference drive source become not more than the predetermined value, press-forming work-pieces at corrected respective speeds of the plurality of drive sources in a production forming.

In the description above, it is desirable that the reference drive source is among the plurality of drive sources a drive source on which the smallest load works at each of the descending displacements.

In the press-forming method of the invention, it is also desirable that the compensation speed (Vn) for a drive source (n) is expressed as $Vf+\Delta Vn$, in which Vf is a target speed for the reference drive source and $\Delta Vn$ is a speed increment for the reference drive source from the target speed (Vf) for the compensation speed (Vn) calculated by using a function that shows a delay of a drive source in terms of a speed of the drive source (n) and a load working on the drive source (n), and that the trial forming is performed by driving each of the plurality of drive sources at a speed of Vf+50 to 90% of the speed increment calculated above.

In the press-forming method described above of the invention, a load working on each of the plurality of drive sources may be measured in a trial forming of a work-piece, or obtained by simulation.

BEST MODE FOR CARRYING OUT OF THE INVENTION

Figure 1:
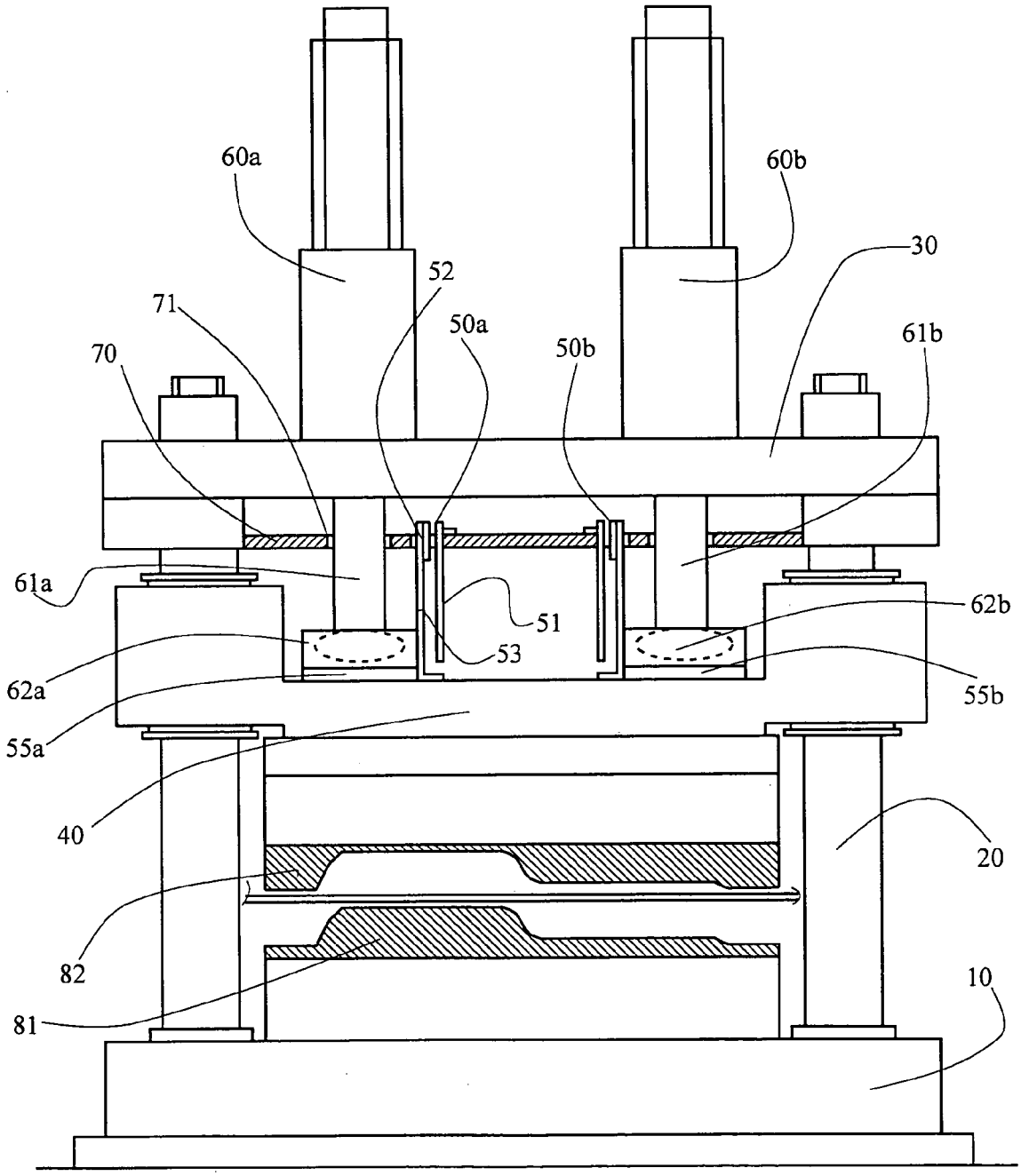
FIG. 1 is a front view of a press machine which can be used for the invention.
Figure 2:
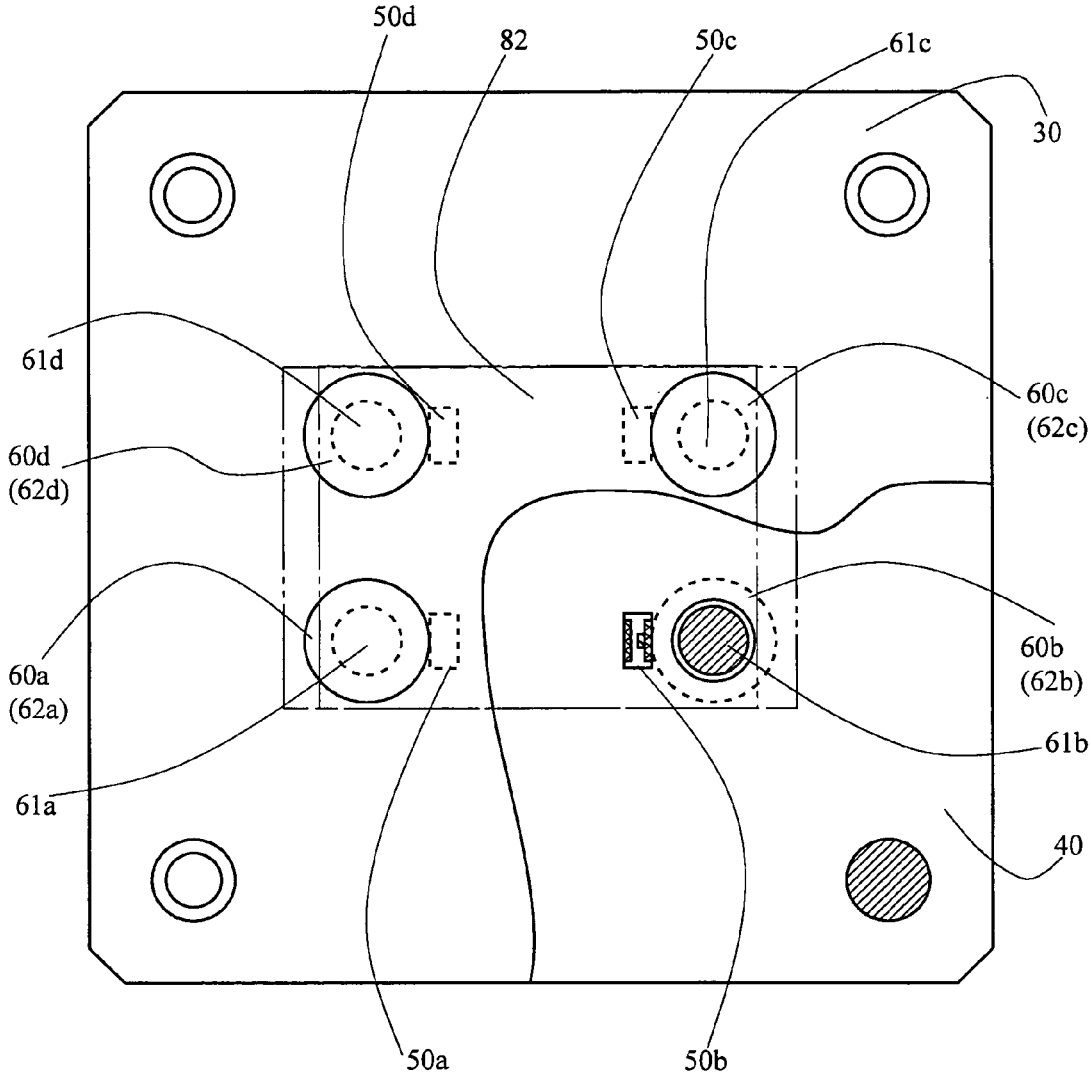
FIG. 2 is a plan view showing the press machine shown in FIG. 1 with an upper support plate being partially removed.

Referring to FIGS. 1 and 2 first, an example of a press machine which can be used for the invention will be described. FIG. 1 is a front view of the press machine, and FIG. 2 is a plan view of the press machine. In FIG. 2, the press machine is shown with an upper support plate partially removed. The press machine has a lower support base 10 fixed on a floor surface, and has an upper support plate 30 by supporting columns 20 made upright on the lower support base. A slide plate 40 capable of reciprocating along the supporting columns 20 is provided between the lower support base 10 and the upper support plate 30, and a forming space exists between the slide plate and the lower support base. In this forming space, a fixed die (lower die) 81 for press-forming is mounted on the lower support base, while a movable die (upper die) 82 corresponding to the fixed die is mounted on an undersurface of the slide plate, and for example, a plate to be formed is placed between these dies and press-formed.

Four of the combinations of servo-motors and decelerating mechanisms are mounted on the upper support plate 30 as drive sources 60*a*, 60*b*, 60*c* and 60*d*. Drive shafts 61*a*, 61*b*, 61*c* and 61*d* that extend in a downward direction from each of the drive sources through through-holes provided in the upper support plate 30 are engaged with each of engaging portions 62*a*, 62*b*, 62*c* and 62*d* on the slide plate 40. For example, a ball screw is attached to each of the drive shafts so as to convert revolution into an up and down movement, and the slide plate is moved up and down by revolution of the serve-motors. Driving mechanisms are constructed by the drive sources, the drive shafts and the engaging portions.

It is preferable that these drive sources are positioned so that pushing pressure onto the slide plate by a plurality of drive sources 60*a*, 60*b*, 60*c* and 60*d* horizontally presses the slide surface and is distributed uniformly on the slide plate. It is preferable that these drive sources generate the pushing pressure of equal magnitude to each other, namely, generate equal output force.

As is apparent from the plan view of FIG. 2, each of the engaging portions 62*a*, 62*b*, 62*c* and 62*d* is provided in a forming area of the forming space. Displacement measuring devices 50*a*, 50*b*, 50*c* and 50*d* are provided near the respective engaging portions 62*a*, 62*b*, 62*c* and 62*d*. As each of the displacement measuring devices 50*a*, 50*b*, 50*c* and 50*d*, a device having a magnetic scale 51 provided with magnetic calibration markings and a magnetic sensor 52 such as a magnetic head provided to face the magnetic scale with a small clearance therebetween can be used. On moving the magnetic sensor 52 relatively to the fixed magnetic scale 51, its absolute position, displacement speed and the like can be measured. Such a displacement measuring device is well known to those skilled in the art as a linear magnetic encoder, and therefore, further explanation win be omitted. As the displacement measuring device, a device which measures a position by light or a sonic wave can be also used. The magnetic scale 51 of each of the displacement measuring devices 50*a*, 50*b*, 50*c* and 50*d* is mounted to a reference plate 70, and the magnetic sensors 52 of the displacement measuring devices are supported by supporting columns 53 mounted to the respective engaging portions 62*a*, 62*b*, 62*c* and 62*d*. Here, the reference plate 70 is maintained at the same position irrespective of the position of the slide plate 40. Therefore, when the slide plate 40 is driven by the drive sources 60*a*, 60*b*, 60*c* and 60*d*, displacement of each of the engaging portions can be measured by the displacement measuring devices 50*a*, 50*b*, 50*c* and 50*d*.

The reference plate 70 that is provided under the upper support plate 30 with a clearance with the upper support plate in FIG. 1, is laid between the supporting columns 20 and fixed, and has a through-hole 71 having a sufficient clearance with the drive shafts at a portion where each of the drive shafts 61*a*, 61*b*, 61*c* and 61*d* is passed, so that any deformation of the drive shafts and the slide plate does not influence the reference plate.

At each of the engaging portions 62*a*, 62*b*, 62*c* and 62*d*, there is a load measuring device 55*a*, 55*b*, 55*c* and 55*d* provided between each of the engaging portions and the slide plate 40 to measure a load working on the slide plate at each of the engaging portions.

Figure 3:
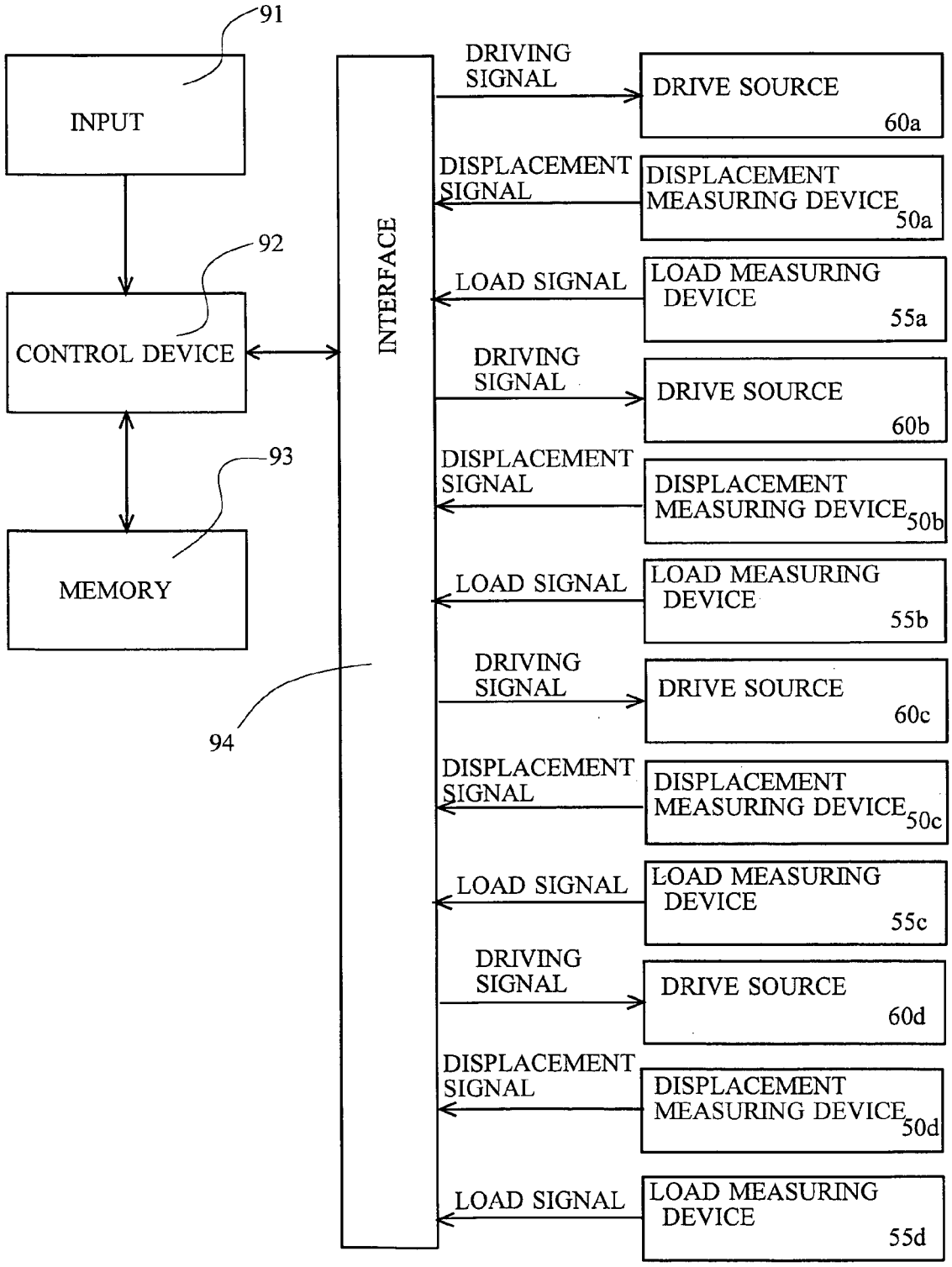
FIG. 3 is a block diagram showing a control system of the press machine which can be used for the invention.

A control system block diagram of the press machine is illustrated in FIG. 3. Before press-forming, for example, a name of a product to be formed, speed of each of the drive sources and the like are inputted to a control device 92 from an input device 91 in advance. The control device 92 has a CPU, to transmit driving signals to the drive sources 60*a*, 60*b*, 60*c* and 60*d* through an interface 94 from the control device 92 to drive each of the drive sources and perform press-forming. Displacement signals of the slide plate are transmitted to the control device 92 from the displacement measuring devices 50*a*, 50*b*, 50*c* and 50*d*. And the load applied on the slide plate is measured by each of the load measuring devices 55*a*, 55*b*, 55*c* and 55*d* and the data about the load is sent to the control device 92.

Figure 4:
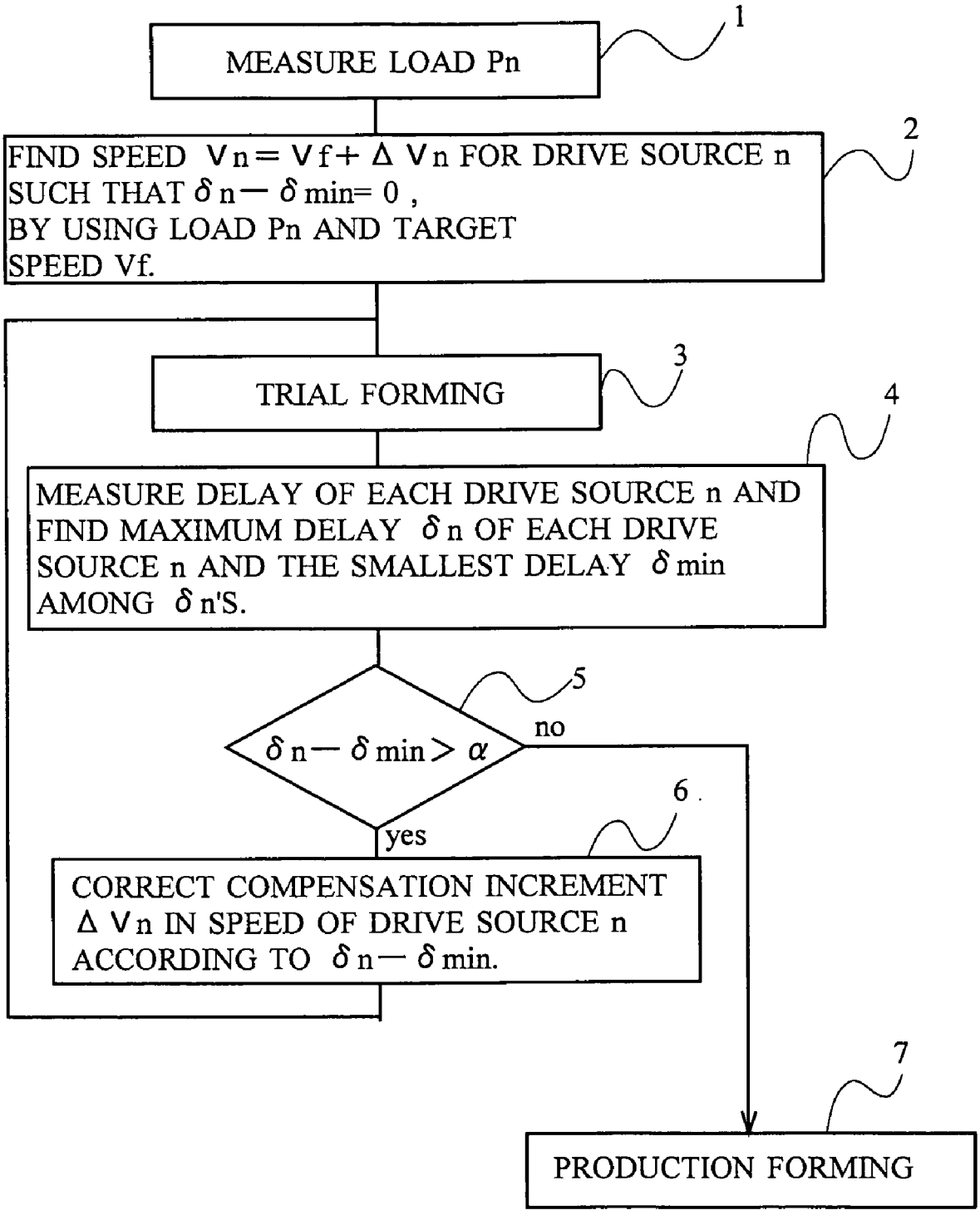
FIG. 4 is a flow chart showing a press forming method according to an example of the invention and FIG. 5 is a graph showing an example of relationship of displacement and delay.

In FIG. 4, a press forming method according to an example of the invention is shown by a flow chart. In step 1 of the flow chart, a trial forming of a work-piece is performed. During the trial forming, a load applied on each of the drive sources 60*a*, 60*b*, 60*c* and 60*d* engaged to the slide plate 40 is measured to obtain loads at each of descending displacements of the slide plate.

That is, a driving signal is supplied to each of the drive sources 60*a*, 60*b*, 60*c* and 60*d* to rotate the servo-motors and to descend the slide plate 40. When a die starts to contact a forming plate to be formed, the loads working on the slide plate are varied to make the slide plate 40 inclined. Descending progresses of the drive sources can be monitored by the descending displacements of the slide plate measured by the displacement measuring devices 50*a*, 50*b*, 50*c* and 50*d* provided adjacent to the drive sources, and a progress of a drive source that is delayed in progress can be hastened. Displacement at a portion of the slide plate at which each of the drive sources is provided is made same to make the slide plate horizontal and descended. Repeating these steps, the slide plate is descended until the end of the press-forming and then after the press-forming, the slide plate is returned to the original place to complete a cycle of the trial forming.

At each of appropriate time periods or each of appropriate displacements during the press-forming, or every time when an inclination of the slide plate exceeds a certain value or when a load difference exceeds a certain value, descending displacements of the slide plate and loads working on each of the drive sources are measured by the load measuring devices 55*a*, 55*b*, 55*c* and 55*d* and the measured data are stored in a memory device 93 to prepare a table of displacements with loads in the memory device. Assume that, when the slide plate is descended, a movable die contacts a forming plate at displacement $l_0$ and respective loads working on the drive sources 60*a*, 60*b*, 60*c* and 60*d* are $P_{a1}$, $P_{b1}$, $P_{c1}$ and $P_{d1}$ when the slide plate reaches displacement $l_1$. Further, the respective loads become $P_{a2}$, $P_{b2}$, $P_{c2}$ and $P_{d2}$ when the slide plate comes to displacement $l_2$. And, the respective loads are $P_{am}$, $P_{bm}$, $P_{cm}$ and $P_{dm}$ when the press forming further progresses and the slide plate is at displacement $l_m$. The table of these displacements with the loads is shown in TABLE 1.

TABLE 1

| | LOAD | | | |
|---|---|---|---|---|
| DISPLACEMENT | DRIVE SOURCE 60a | DRIVE SOURCE 60b | DRIVE SOURCE 60c | DRIVE SOURCE 60d |
| $l_1$ | $P_{a1}$ | $P_{b1}$ | $P_{c1}$ | $P_{d1}$ |
| $l_2$ | $P_{a2}$ | $P_{b2}$ | $P_{c2}$ | $P_{d2}$ |
| . . . | . . . | . . . | . . . | . . . |
| $l_m$ | $P_{am}$ | $P_{bm}$ | $P_{cm}$ | $P_{dm}$ |
| . . . | . . . | . . . | . . . | . . . |

The loads working on each of the drive sources change in magnitude of the loads and position of the loads like, for example, at displacement $l_1$, $P_{a1}$ is the largest and $P_{d1}$ is the smallest, while $P_{b2}$ is the largest and $P_{d2}$ is the smallest at displacement $l_2$. It is assumed that $P_{am}<P_{dm}<P_{bm}<P_{cm}$ at displacement $l_m$.

In this example, respective loads working on the drive sources are measured in a trial forming, but the loads at each of displacements may be obtained by simulation.

Figure 5:
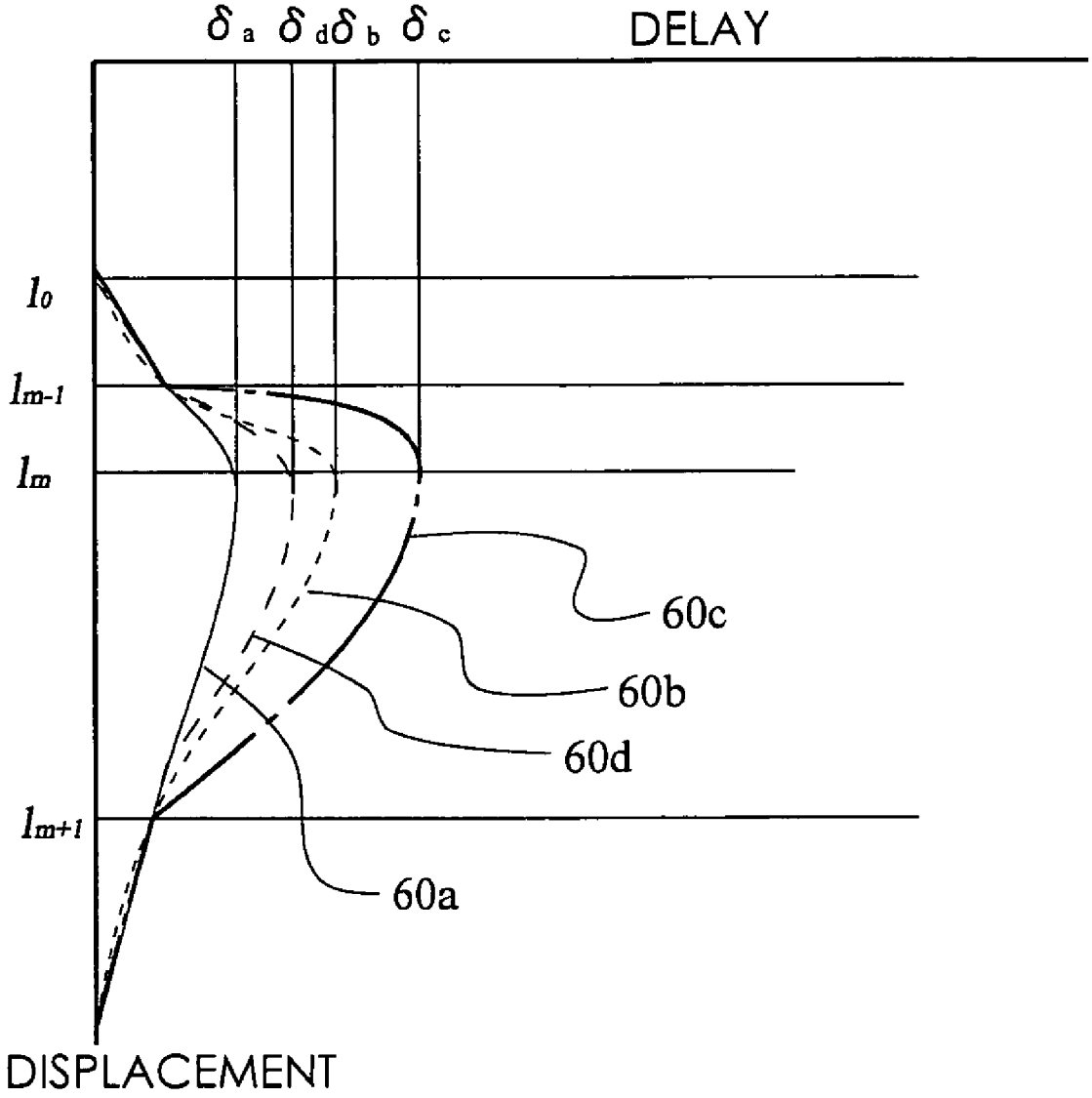

As shown in FIG. 5, by the loads $P_{am}$, $P_{bm}$, $P_{cm}$ and $P_{dm}$ working on the drive sources at displacement $l_m$, the drive source 60*c* is most delayed in descending displacement among the drive sources and the delay is δc, while the drive source 60*a* is least delayed in descending displacement and the delay is δa. In FIG. 5, the vertical axis is an instructed displacement and the horizontal axis is a delay δ of actual displacement from the instructed displacement of the slide plate near each of the drive sources. At instructed displacement $l_{m-1}$, there is no relative delay among the drive sources. The relative delay becomes largest at $l_m$ and returns to zero at $l_{m+1}$. Since the load on the drive source 60*a* is smallest among the loads on respective drive sources at displacement $l_m$ and the delay in descending displacement of the drive source 60*a* is smallest, the drive source is set to a reference drive source.

Since the delay δa is the smallest among the largest delays δa, δb, δc and δd of the drive sources in displacement period of $l_{m-1}$ to $l_{m+1}$, δa is set to δmin. A target speed of the drive source 60*a* (reference drive source) that the smallest load is applied on in the displacement period of $l_{m-1}$ to $l_{m+1}$ is set to Vf. The target speed is a speed for a production forming of a drive source. In step 2, speeds Vn (n:b, c and d) of each of the drive sources n are obtained to equalize delays of the drive sources with the delay δmin of the drive source 60*a*, by using loads $P_{am}$, $P_{bm}$, $P_{cm}$ and $P_{dm}$ working on the drive sources 60*a*, 60*b*, 60*c* and 60*d* and the target speed Vf of the drive source 60*a*.

Since a delay δ of a portion, on which a load P works, from an instructed displacement is in general expressed by a function of its speed V and a load P, δ=f(V, P). When the drive source 60*a* is driven at a speed Vf, a speed Vn of a drive source n that has the same delay δn as the delay δmin of the drive source 60*a* is calculated as follows.

Namely, Vn (n=b, c, d) is obtained from $f(Vn, P_{nm})=f(Vf, P_{am})$, since δn−δmin=0.

Using speeds of the drive sources obtained, a work-piece is press-formed for trial forming in step 3. The speed Vn obtained above for each of the drive sources n may be expressed as a sum of a target speed Vf of the reference drive source and a speed increment ΔVn. It is preferable that a speed of each of the drive sources is set to 50% to 90% of the obtained increment ΔVn in the trial forming in step 3. This is because the calculated speed Vn is reduced since the speed Vn calculated above is applied during the period of displacement $l_{m-1}$ to displacement $l_{m+1}$, assuming that there is a uniform delay during the period. Further more, since a speed increment is obtained by calculation here and there might be a risk in applying the calculated speed increment to a real press machine, it is better to use a less speed increment than that to avoid the risk. Although a drive source of the smallest load is used as the reference drive source in the explanation, another drive source may be a reference drive source. When another drive source is used as a reference drive source, an increment ΔVn might be negative and that should be taken care.

During the trial forming in step 3, delays of the drive sources are measured and, in step 4, the largest value δn of a delay for each of the drive sources n is obtained and the smallest value among the largest values is set to δmin. In step 5, the largest delay δn for each of the drive sources n is compared with the smallest value δmin among the largest values δn's and, if the difference between on and δmin is more than a predetermined value α, the compensation increment ΔVn used before is corrected in step 6, and steps 3, 4 and 5 are repeated. Although it is necessary that the value a for comparison of the difference between δn and δmin is such an inclination that dies is not broken (for example, less than 100 μm), it is preferable that the criteria is less than 10 μm for increase of accuracy of products, specifically about 3 μm.

If the difference between the largest delay δn for each of the drive sources n and the smallest delay value δmin among the largest delays is less than or equal to the predetermined value a in the comparison of step 5, the flow goes to step 7 and a production forming of a work-piece is performed, using speeds of the drive sources obtained in a previous cycle.

INDUSTRIAL APPLICABILITY

When work-pieces are press-formed while the horizontal state of the slide plate is maintained by a feedback control, much time is taken for one cycle of the press-forming. However, if the production forming is performed by setting the speed of each of the drive sources so that the horizontal state of the slide plate can be maintained as in the invention, high descending speed of the slide plate can be selected in the production forming, and therefore, during press-forming, the forming can be performed at high forming speed suitable for production forming while the slide plate is maintained horizontal.

The invention claimed is:

1. A press forming method comprising the steps of:

providing a press machine comprising a fixed plate, a slide plate disposed to face the fixed plate and movable relatively to the fixed plate and a plurality of drive sources each having a servo-motor for driving the slide plate and pressing each of a plurality of engaging portions positioned on the slide plate to press horizontally the slide plate, measuring a load working on each of the plurality of drive sources at each of descending displacements of the slide plate, while the slide plate is displaced to press-form a work-piece, applying the load at each of the descending displacements and a target speed for production forming for one (hereinafter referred to as "reference drive source") of the plurality of drive sources at each of the descending displacements to a function that shows a delay of a drive source from an instructed displacement in terms of a speed of the drive source and a load working on the drive source, thereby calculating a speed (hereinafter referred to as "compensation speed") for each of the plurality of drive sources to eliminate a delay for each of the plurality of drive sources from the reference drive source, driving each of the plurality of drive sources at the compensation speed to press-form a work-piece in a trial forming, measuring a delay of each of the plurality of drive sources during the trial forming, until delays of other drive sources from the reference drive source become not more than a predetermined value, repeating correction of the compensation speed, the trial forming and the measurement of the delay during the trial forming, and when the delays of the other drive sources from the reference drive source become not more than the predetermined value, press-forming work-pieces at corrected respective speeds of the plurality of drive sources in a production forming.

2. A press forming method as set forth in claim 1, wherein the reference drive source is among the plurality of drive sources a drive source on which the smallest load works at each of the descending displacements.

3. A press forming method as set forth in claim 1, wherein the compensation speed (Vn) for a drive source (n) is expressed as $Vf+\Delta Vn$, in which Vf is a target speed for the reference drive source and $\Delta Vn$ is a speed increment for the reference drive source from the target speed (Vf) for the compensation speed (Vn) calculated by using a function that shows a delay of a drive source in terms of a speed of the drive source (n) and a load working on the drive source (n), and the trial forming is performed by driving each of the plurality of drive sources at a speed of Vf+50 to 90% of the speed increment calculated above.

4. A press forming method as set forth in claim 2, wherein the compensation speed (Vn) for a drive source (n) is expressed as $Vf+\Delta Vn$, in which Vf is a target speed for the reference drive source and $\Delta Vn$ is a speed increment for the reference drive source from the target speed (Vf) for the compensation speed (Vn) calculated by using a function that shows a delay of a drive source in terms of a speed of the drive source (n) and a load working on the drive source (n), and the trial forming is performed by driving each of the plurality of drive sources at a speed of Vf+50 to 90% of the speed increment calculated above.

* * * * *